US008534180B2

(12) United States Patent
Becker et al.

(10) Patent No.: US 8,534,180 B2
(45) Date of Patent: Sep. 17, 2013

(54) WEAPON SYSTEM WITH A CARRIER VEHICLE AND A PREFERABLY VEHICLE DEPENDENT MORTAR

(75) Inventors: Wilfried Becker, Oelde (DE); Wolfgang Boer, Hermannsburg (DE); Hans-Ulrich Desgranges, Celle (DE); Hans Moser, Celle (DE)

(73) Assignee: Rheinmetall Landsysteme GmbH, Kiel (DE)

( * ) Notice: Subject to any disclaimer, the term of this patent is extended or adjusted under 35 U.S.C. 154(b) by 0 days.

(21) Appl. No.: 13/089,040

(22) Filed: Apr. 18, 2011

(65) Prior Publication Data

US 2012/0024141 A1 Feb. 2, 2012

Related U.S. Application Data

(63) Continuation-in-part of application No. PCT/EP2009/006919, filed on Sep. 25, 2009.

(30) Foreign Application Priority Data

Oct. 17, 2008 (DE) ..... 10 2008 052 074

(51) Int. Cl.
*F41F 1/06* (2006.01)

(52) U.S. Cl.
USPC ..... 89/37.05; 89/40.02; 89/40.03

(58) Field of Classification Search
USPC ..... 89/1.35, 1.3, 37.05, 40.02, 40.03, 89/40.01
See application file for complete search history.

(56) References Cited

U.S. PATENT DOCUMENTS

| | | | |
|---|---|---|---|
| 477,946 | A | 6/1892 | Livingston et al. |
| 1,445,126 | A | 2/1923 | Bergman |
| 1,524,273 | A | 1/1925 | Newton |
| 2,030,507 | A | 2/1936 | Driggs |

(Continued)

FOREIGN PATENT DOCUMENTS

| | | | |
|---|---|---|---|
| DE | 31 21 999 | A1 | 12/1982 |
| DE | 34 23 010 | A1 | 1/1986 |

(Continued)

OTHER PUBLICATIONS

Plastic Deformation at http://www.matter.org.uk/schools/content/hookeslaw/plastic.html, downloaded Apr. 20, 2011, 1 page.

(Continued)

*Primary Examiner* — Bret Hayes
*Assistant Examiner* — Joshua Freeman
(74) *Attorney, Agent, or Firm* — Griffin & Szipl, P.C.

(57) ABSTRACT

A weapon system includes a carrier vehicle and a vehicle dependent mortar, wherein the carrier vehicle has a crew space and a weaponry space to house the mortar, and the mortar is charged in an index position with mortar grenades, with several sheddable propellant modules on the tail shaft thereof. The weapon system avoids manual loading of the mortar with mortar grenades because an automatic loader is arranged in a weapon space separated from the crew space by a separating wall. The loader transports the mortar grenade from a magazine in the weapon space into the index position of the barrel of the mortar and axially inserts it into the mouth of the barrel, and an automatic shedding device is arranged in the weapon space to automatically remove unnecessary propellant modules from the mortar grenade after fixing target parameters and before insertion of the mortar grenade into the barrel.

21 Claims, 1 Drawing Sheet

(56) References Cited

U.S. PATENT DOCUMENTS

| | | | | | |
|---|---|---|---|---|---|
| 2,197,816 | A | | 4/1940 | Tate | |
| 2,337,309 | A | | 12/1943 | Caulkins | |
| 2,337,647 | A | | 12/1943 | Caulkins | |
| 2,353,971 | A | | 7/1944 | Shaffer et al. | |
| 2,438,165 | A | * | 3/1948 | Haas | 89/6 |
| 2,922,338 | A | * | 1/1960 | Barbe | 89/1.3 |
| 3,011,407 | A | | 12/1961 | Van Koningsveld | |
| 3,124,070 | A | * | 3/1964 | Jasse | 102/373 |
| 3,208,348 | A | | 9/1965 | Lee | |
| 3,326,082 | A | | 6/1967 | Johnson, Jr. et al. | |
| 3,501,997 | A | | 3/1970 | Winsen et al. | |
| 3,512,449 | A | | 5/1970 | Stoner | |
| 3,672,255 | A | | 6/1972 | Findlay et al. | |
| 3,738,219 | A | | 6/1973 | Febres | |
| 3,771,417 | A | | 11/1973 | Schnabele et al. | |
| 3,800,656 | A | | 4/1974 | Schnabele | |
| 3,818,794 | A | * | 6/1974 | Mayer et al. | 89/40.03 |
| 3,838,622 | A | | 10/1974 | Febres | |
| 3,894,473 | A | * | 7/1975 | Marest et al. | 89/37.05 |
| 3,946,637 | A | | 3/1976 | Campagnuolo et al. | |
| 4,011,794 | A | * | 3/1977 | Leshem | 89/47 |
| 4,019,423 | A | | 4/1977 | Johnson | |
| 4,022,102 | A | * | 5/1977 | Ettel | 89/6.5 |
| 4,088,057 | A | | 5/1978 | Nasypany | |
| 4,157,054 | A | | 6/1979 | Cobb | |
| 4,172,420 | A | | 10/1979 | Voss et al. | |
| 4,198,897 | A | * | 4/1980 | Lipp et al. | 89/13.05 |
| 4,406,209 | A | | 9/1983 | Arene et al. | |
| 4,489,639 | A | * | 12/1984 | Winkler et al. | 89/37.01 |
| 4,549,487 | A | * | 10/1985 | Jensen | 102/498 |
| 4,583,444 | A | * | 4/1986 | Jackson | 89/36.13 |
| 4,607,562 | A | * | 8/1986 | LeBlanc | 89/40.03 |
| 4,616,127 | A | * | 10/1986 | Whiting | 235/412 |
| 4,669,357 | A | * | 6/1987 | von Laar et al. | 89/40.02 |
| 4,682,528 | A | | 7/1987 | Wohler | |
| 4,686,885 | A | * | 8/1987 | Bai | 89/6.5 |
| 4,711,180 | A | * | 12/1987 | Smolnik | 102/445 |
| 4,721,026 | A | | 1/1988 | Arana Ibarra | |
| 4,753,156 | A | | 6/1988 | Winkler et al. | |
| 4,898,097 | A | * | 2/1990 | Jordan et al. | 102/283 |
| 4,949,491 | A | | 8/1990 | Broske | |
| 4,974,491 | A | * | 12/1990 | von Laar et al. | 89/37.05 |
| 5,050,479 | A | * | 9/1991 | Heintz et al. | 89/46 |
| 5,123,329 | A | | 6/1992 | Irwin | |
| 5,160,801 | A | * | 11/1992 | Andersen et al. | 89/6 |
| 5,343,795 | A | * | 9/1994 | Ziemba et al. | 89/6.5 |
| 5,491,917 | A | | 2/1996 | Dihan et al. | |
| 5,677,507 | A | * | 10/1997 | Becker et al. | 89/47 |
| 5,827,991 | A | | 10/1998 | Predazzer | |
| 6,000,313 | A | | 12/1999 | Becker | |
| 6,095,026 | A | * | 8/2000 | Poussard et al. | 89/46 |
| 6,286,408 | B1 | | 9/2001 | Sanford et al. | |
| 6,289,780 | B1 | * | 9/2001 | Heldmann | 89/6.5 |
| 6,457,396 | B1 | * | 10/2002 | Bean et al. | 89/40.04 |
| 6,460,448 | B1 | * | 10/2002 | Zangrando | 89/45 |
| 6,591,733 | B1 | * | 7/2003 | Engstrom | 89/45 |
| 6,684,547 | B2 | | 2/2004 | Poff, Jr. | |
| 6,769,344 | B2 | * | 8/2004 | Domeij | 86/46 |
| 7,124,690 | B1 | * | 10/2006 | Tadros et al. | 102/370 |
| 7,669,513 | B2 | * | 3/2010 | Niv et al. | 89/40.03 |
| 8,418,389 | B1 | | 4/2013 | Lukman et al. | |
| 2003/0056639 | A1 | | 3/2003 | Giza | |
| 2004/0216597 | A1 | * | 11/2004 | Kohlstedt et al. | 89/40.03 |
| 2005/0268806 | A1 | * | 12/2005 | Harjula et al. | 102/291 |
| 2006/0288857 | A1 | * | 12/2006 | Laine | 89/37.05 |
| 2007/0074625 | A1 | * | 4/2007 | Seidensticker et al. | 89/6.5 |
| 2007/0119296 | A1 | * | 5/2007 | Niv et al. | 89/37.02 |
| 2007/0241227 | A1 | * | 10/2007 | Zemany et al. | 244/3.1 |
| 2009/0126558 | A1 | | 5/2009 | Kohnen | |
| 2010/0170128 | A1 | | 7/2010 | Werner | |
| 2010/0192439 | A1 | | 8/2010 | Murello | |
| 2012/0255426 | A1 | * | 10/2012 | Reynard et al. | 89/6.5 |

FOREIGN PATENT DOCUMENTS

| | | | |
|---|---|---|---|
| DE | 1 9713 192 | A1 | 10/1998 |
| DE | 10 2004 050 215 | A1 | 2/2006 |
| DE | 10 2004 050 218 | A1 | 2/2006 |
| DE | 10 2006 014 155 | A1 | 9/2007 |
| DE | 10 2006 029330 | A1 | 12/2007 |
| EP | 0 429 320 | A1 | 5/1991 |
| EP | 0 965 814 | A2 | 12/1999 |
| FR | 2 532 413 | A1 | 3/1984 |
| FR | 2 647 888 | A | 12/1990 |
| GB | 2 131 928 | A1 | 6/1984 |
| GB | 2 325 509 | A | 11/1998 |
| WO | 97/48959 | A1 | 12/1997 |
| WO | 2005075933 | A1 | 8/2005 |

OTHER PUBLICATIONS

International Search Report issued in corresponding International Application Application No. PCT/EP2009/006919, completed Nov. 30, 2009, mailed Dec. 8, 2009.

* cited by examiner

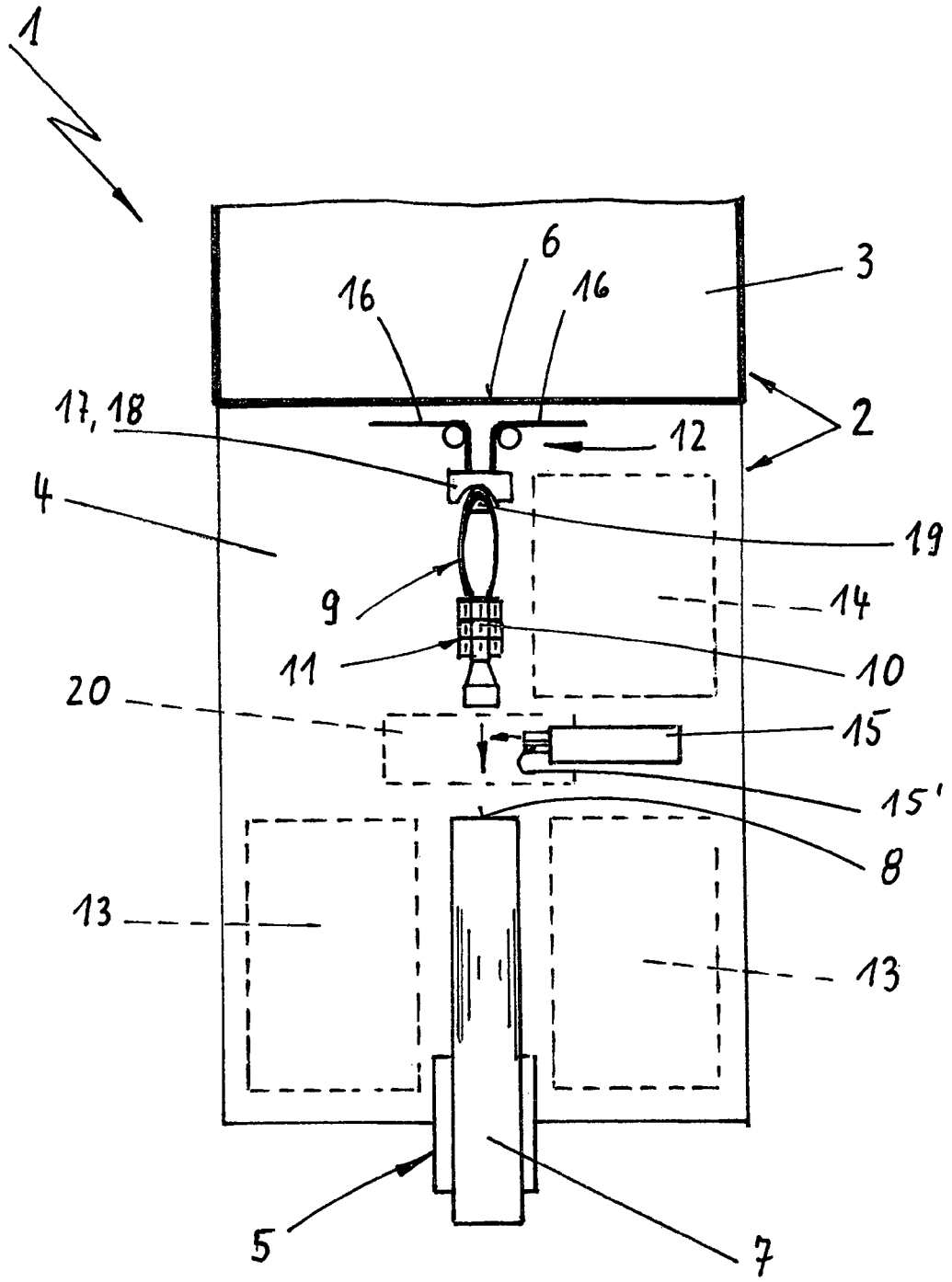
1
6
3
16
16
17, 18
12
2
4
19
9
14
11
10
20
15
15'
8
13
13
5
7

WEAPON SYSTEM WITH A CARRIER VEHICLE AND A PREFERABLY VEHICLE DEPENDENT MORTAR

This is a Continuation-in-Part Application in the United States of International Patent Application No. PCT/EP2009/006919 filed Sep. 25, 2009, which claims priority on German Patent Application No. 10 2008 052 074.8, filed Oct. 17, 2008. The entire disclosures of the above patent applications are hereby incorporated by reference.

FIELD OF THE INVENTION

The invention relates to a weapon system having a carrier vehicle and a mortar, preferably a vehicle-mounted mortar.

BACKGROUND OF THE INVENTION

By way of example, a weapon system such of this kind is disclosed in DE 197 13 192 C2. This weapon system essentially consists of a carrier vehicle that comprises a crew area and a weapon area, which is provided at the rear of the carrier vehicle, for holding at least one mortar. In this case, the mortar can be loaded with mortar shells through the muzzle of the weapon barrel.

DE 10 2004 050 218 discloses a munition magazine for large-caliber munitions.

DE 10 2004 050 215 A1 deals with a corresponding munition chain. Although this is not described in any more detail, this design could have a motor added to it, thus allowing the chain to be electrically driven.

While, in the case of known vehicle-mounted mortars, the weapon barrel can be aimed by means of drives that can be operated automatically, the loading of the weapon with mortar shells generally has to be carried out manually, as in the past. A loader (i.e., a person) is, therefore, normally provided, who not only determines the necessary number of propellant charge modules arranged on the fin structure of the mortar shell, once the target parameters have been defined, and manually removes modules that are not required, but also the loader manually programs the fuze in the case of mortar shells with a programmable fuze.

It has been generally impossible to provide a weapon area, for a vehicle mortar, this is without a crew because someone has had to manually load the mortar with suitable mortar shells. Because of the safety conditions that have to be taken into account for this manual loader (e.g., sufficient armor protection, avoidance of impermissibly high CO load and/or NBC (Nuclear, Biological and Chemical) load as well as protection against deflagration of the munition as a consequence of external influences), compact integration of the mortar in the carrier vehicle is difficult, and complete separation of the crew area from a weapon area (i.e., separating the crew from the weapon area so no crew member is in the weapon area) has been generally impossible.

The present invention is based on the object of specifying a weapon system of the type mentioned initially, in which there is no need to manually load the mortar with suitable mortar shells.

SUMMARY OF THE INVENTION

According to the present invention, this object is achieved by the features of a weapon system, according to a first embodiment, which has a carrier vehicle (2) and a mortar (5), for example a vehicle-mounted mortar (5), wherein the mortar (5) can be loaded with a munition (9), in particular with a mortar shell, wherein the mortar shells have a plurality of propellant charge modules (11), which can be stripped off at the side, on their fin structure (10), and the mortar (5) can then be pivoted to a firing position which is appropriate for the predetermined target parameters, characterized in that (a) a controllable automatic loading device (12) is arranged that takes the respective mortar shell (9) from a munition magazine (13, 14) that is likewise located in the weapon area (4), and (b) a controllable automatic stripping device (15) is arranged, which automatically pushes those propellant charge modules (11) that are not required after definition of the target parameters off the fin structure (10) of the mortar shell (9), before the corresponding mortar shell (9) is pushed into the weapon barrel (7). Additional, particularly advantageous refinements of the invention are disclosed in the other embodiments.

For example, in accordance with a second embodiment of the present invention, the first embodiment is modified so that a collecting container (20) for the propellant charge modules (11) that are not required is arranged underneath the stripping device (15). In accordance with a third embodiment of the present invention, the first embodiment is modified so that a collecting container, which is arranged at the side, can be provided for the excess propellant charge modules. In accordance with a fourth embodiment of the present invention, the first embodiment, the second embodiment, and the third embodiment, may be further modified so that, in order to fire mortar shells (9) with a programmable nose fuze (19), the loading device (12) of the mortar (5) contains a fuze programming device (18), which programs the nose fuze (19) of the mortar shell (9) appropriately with a fire command during its loading process. In accordance with a fifth embodiment of the present invention, the first embodiment, the second embodiment, the third embodiment and the fourth embodiment are further modified so that the loading device (12) has an operating part (17) that is in the form of a shroud, by means of which the mortar shell (9) is pushed axially into the weapon barrel (7) and via which the nose fuze (19) can be programmed.

In accordance with a sixth embodiment of the invention, the first embodiment, the second embodiment, the third embodiment and the fourth embodiment are further modified so that a separating wall (6) is provided between the crew area (3) and the weapon area (4). In accordance with a seventh embodiment of the invention, the fifth embodiment or the sixth embodiment is further modified so that the separating wall (6) between the crew area (3) and the weapon area (4) is composed of armored steel. In accordance with an eighth embodiment of the present invention, the fifth embodiment and the sixth embodiment may be further modified so that the loading apparatus (12) and the stripping device (15), which can be controlled from the crew area (3), are arranged in the weapon area (4).

In accordance with ninth embodiment of the present invention, a weapon system is provided that is mountable to a carrier vehicle, wherein the weapon system comprises a mortar, wherein the mortar is capable of being loaded with a mortar shell, wherein the mortar shell has a plurality of first propellant charge modules that are capable of being stripped off at a side of a fin structure of the mortar shell, and the mortar is pivotable from an index position to a firing position that is appropriate for one or more predetermined target parameters, wherein the weapon system further comprises: a weapon area that includes a controllable automatic loading device arranged to take the mortar shell from a munition magazine in the weapon area; and a controllable automatic stripping device arranged to automatically push one or more second propellant charge modules of the plurality of first propellant charge modules off the fin structure of the mortar shell before the mortar shell is pushed into a weapon barrel of the mortar by the loading device, wherein the one or more second propellant charge modules are excess propellant charge modules that are not required after definition of the predetermined target parameters. In accordance with an tenth embodiment of the present invention, the ninth embodiment is modified so that it includes a collecting container arranged underneath the stripping device in order to collect the one or more second propellant charge modules stripped from the mortar shell by the stripping device, and wherein the weapon system is detachable from the carrier vehicle so as to function independently from the carrier vehicle. In accordance with a eleventh embodiment of the present invention, the ninth embodiment is modified so that it includes a collecting container arranged at a side of the weapon area in order to collect the excess propellant charge modules stripped from the mortar shell by the stripping device, and wherein the weapon system is detachable from the carrier vehicle so as to function independently from the carrier vehicle.

In accordance with a twelfth embodiment of the present invention, the ninth embodiment, the tenth embodiment, and the eleventh embodiment, may be further modified so that, in order to fire mortar shells (9) with a programmable nose fuze (19), the loading device (12) of the mortar (5) contains a fuze programming device (18), which programs the nose fuze (19) of the mortar shell (9) appropriately with a fire command during its loading process. In accordance with a thirteenth embodiment of the present invention, the ninth embodiment, the tenth embodiment, the eleventh embodiment and the twelfth embodiment are further modified so that the loading device (12) has an operating part (17) that is in the form of a shroud, by means of which the mortar shell (9) is pushed axially into the weapon barrel (7) and via which the nose fuze (19) can be programmed.

In accordance with a fourteenth embodiment of the invention, the ninth embodiment, the tenth embodiment, the eleventh embodiment and the twelfth embodiment are further modified so that a separating wall (6) is provided between the crew area (3) and the weapon area (4). In accordance with a fifteenth embodiment of the invention, the fourteenth embodiment or the fifteenth embodiment is further modified so that the separating wall (6) between the crew area (3) and the weapon area (4) is composed of armored steel. In accordance with an sixteenth embodiment of the present invention, the thirteenth embodiment and the fourteenth embodiment may be further modified so that the loading apparatus (12) and the stripping device (15), which can be controlled from the crew area (3), are arranged in the weapon area (4).

The invention is essentially based on the idea of arranging an automatic loading device, which can be controlled from the crew area, in the weapon area, which is separated from the crew area of an object or vehicle by a separating wall, wherein the loading device takes the respective mortar shell from a munition magazine, which is likewise located in the weapon area, transports it in an index position for the weapon barrel, in front of the muzzle of the weapon barrel, and then pushes it axially into the muzzle of the weapon barrel, with an automatic stripping device, which can likewise be controlled from the crew area, but is arranged in the weapon area, wherein the automatic stripping device automatically pushes those propellant charge modules, which are not required after definition of the target parameters, off the fin structure of the mortar shell, before the corresponding mortar shell is pushed into the weapon barrel. In this case, the stripping device acts at the end of the propellant charge module to be stripped off, preferably spreads it and pushes it off the fin structure. In the process, the module is preferably caught by a container, in order, for example, to allow the stripped module to be reused.

If the mortar shells have a programmable nose fuze instead of an impact fuze, then a fuze programming device can be integrated in the loading device for the mortar, which appropriately programs the nose fuze of the mortar shell during its loading process, once the target data is available. Fuze programming units and appropriate methods are known.

However, known programming units are accommodated in the bottom part of a weapon barrel. Because of the design of a conventional mortar shell, this configuration cannot be moved, however, as a result of which, in a development of the present invention, the loading device is preferably provided with an operating part that contains the fuze programming device, such as is in the form of a shroud and at least partially surrounds the nose of the mortar shell—and therefore also program the nose fuze. This operating part can then be used not only to push the mortar shell axially into the weapon barrel but also, at the same time, to program the nose fuze.

A collecting container can be provided underneath the stripping device in order to catch the excess propellant charge modules, with the propellant charge modules falling into the collecting container after the stripping process. However, it is also possible for the excess propellant charge modules to be pushed by the stripping device into a collecting container arranged at the side.

The present design allows complete separation between the crew area, or the like, and a weapon area that does not have any crew (i.e., a weapon area without any crew, because the crew are located in the separate crew area).

Further details and advantages of the invention will become evident from the following exemplary embodiment, which will be explained with reference to a FIGURE.

BRIEF DESCRIPTION OF THE FIGURE(S)

This FIGURE shows a schematic plan view of the rear area of a weapon system having a vehicle-mounted mortar, with the weapon barrel of the mortar being in its index position (in this case a weapon barrel pivoted toward the carrier vehicle with an elevation of) 0°.

DETAILED DESCRIPTION OF THE INVENTION

The weapon system according to the present invention is annotated with the reference symbol 1 and comprises a carrier vehicle 2, which contains a crew area 3 and a weapon area 4 for holding the vehicle-mounted mortar 5. In this case, the crew area 3 and the weapon area 4 are separated from one another by a separating wall 6 composed of armored steel.

The weapon barrel 7, which is located in its index position, of the mortar 5 is intended to be loaded with a mortar shell 9 through its muzzle 8, with the mortar shell 9 having three propellant charge modules 11, which can be stripped off at the side, on its fin structure 10.

According to the invention, an automatic loading device 12, which can be controlled from the crew area 3, is now arranged in the weapon area 4, and takes the respective mortar shell 9 from a munition magazine 13 or 14, which is likewise located in the weapon area 4, and transports it to the weapon barrel 7, which is located in its index position, so that the mortar shell 9 can then be pushed axially into the muzzle 8 of the weapon barrel 7 by, for example, a stripping device 15.

If it is now found on determining the target parameters that only a single propellant charge module 11 is required instead of the three original propellant charge modules 11 located on the fin structure 10, a stripping device 15, which is arranged in front of the muzzle 8 of the weapon barrel 7 in the weapon area 4, is activated automatically and automatically pushes the two extra propellant charge modules 11, which are not required based on the target parameters, away from the fin structure 10 of the mortar shell 9 at the side, by means of two movable stripper parts 15' in the form of tongues. In other words, the two movable stripper parts 15' of the stripping device 15 are used to automatically push the extra propellant charge modules away from the fin structure 10 and to a side of the mortar shell 9.

A collecting container 20 is arranged underneath the stripping device 15 in the weapon area 4. The stripped propellant charge modules 11, which are not required based on target parameters, and have been stripped off the fin structure 10, fall into the collecting container 20.

In the illustrated exemplary embodiment, the loading device 12 consists of two rigid-back chains 16, which act on an operating part 17 in the form of a shroud. This operating part 17 partially surrounds the nose of the mortar shell 9 and, during the loading process, pushes the mortar shell 9 axially in the direction of the muzzle 8 of the weapon barrel 7 (which is in its index position).

A fuze programming device 18 is also integrated in the operating part 17. Using the fuze programming device 18, a nose fuze 19 of the mortar shell 9 is programmed with the ignition timings determined from the target data, wherein the fuze programming device programs the nose fuze 19 during the process of loading the mortar 5.

As soon as the mortar shell 9 has been pushed into the weapon barrel 7, the weapon barrel 7 is pivoted by means of actuating drives, which are not illustrated, to its firing position, which is predetermined by the target parameters, and a firing device is then operated to fire the mortar (5).

In a preferred embodiment of the present invention, the weapon system 1 is a mortar mountable on the carrier vehicle 2 so that the weapon system 1 functions independently of the carrier vehicle 2. In accordance with this embodiment of the invention, the carrier vehicle 2 serves the purpose of carrying various building blocks or modules, such as, for example, the stripping off device 15 (also called the ejection device), or chains, etc. In accordance with this embodiment of the invention, the carrier vehicle 2 is a carrier component of a larger assembly provided with detachable parts. In this embodiment of the invention, the carrier vehicle 2 is not a component of the weapon system 1, although the weapon system 1 may be used in combination with the carrier vehicle 2, or the weapon system 1 may be detached and used independently from the carrier vehicle 2.

LIST OF REFERENCE SYMBOLS

1 Weapon system
2 Carrier vehicle
3 Crew area
4 Weapon area
5 Mortar
6 Separating wall
7 Weapon barrel
8 Muzzle
9 Mortar shell
10 Fin structure
11 Propellant charge module
12 Loading device
13, 14 Munition magazine
15 Stripper device
15' Stripper parts
16 Rigid-back chain
17 Operating part
18 Fuze programming device
19 Nose fuze
20 Collecting container

The invention claimed is:

1. A weapon system comprising a carrier vehicle and a mortar mounted to the vehicle, wherein the mortar is capable of loading with a mortar shell, wherein the mortar shell has a plurality of first propellant charge modules that are capable of stripping off at a side of a fin structure of the mortar shell, and the mortar is pivotable from an index position to a firing position that is appropriate for one or more predetermined target parameters, wherein the weapon system further comprises:

(a) a weapon area that includes a controllable automatic loading device arranged to take the mortar shell from a munition magazine in the weapon area; and (b) a controllable automatic stripping device arranged to automatically push one or more second propellant charge modules of the plurality of first propellant charge modules off the fin structure of the mortar shell before the mortar shell is pushed into a weapon barrel of the mortar by the loading device, wherein the one or more second propellant charge modules are excess propellant charge modules that are not required after definition of the predetermined target parameters.

2. The weapon system as claimed in claim 1, further comprising:

(c) a collecting container arranged underneath the stripping device in order to collect the one or more second propellant charge modules stripped from the mortar shell by the stripping device.

3. The weapon system as claimed in claim 2, wherein the mortar shell further comprises a programmable nose fuze, and in order to fire the mortar shell provided with the programmable nose fuze, the loading device of the weapon system comprises a fuze programming device that programs the nose fuze of the mortar shell appropriately with a fire command during a loading process of the mortar shell performed by the loading device.

4. The weapon system as claimed in claim 2, wherein the loading device comprises an operating part that comprises a shroud, wherein the shroud is disposed to push the mortar shell axially into the weapon barrel and the operating part programs a nose fuze of the mortar shell during a loading process of the mortar shell performed by the loading device.

5. The weapon system as claimed in claim 1, further comprising:

(c) a collecting container arranged at a side of the weapon area in order to collect the excess propellant charge modules stripped from the mortar shell by the stripping device.

6. The weapon system as claimed in claim 5, wherein the mortar shell further comprises a programmable nose fuze, and in order to fire the mortar shell provided with the programmable nose fuze, the loading device of the weapon system comprises a fuze programming device that programs the nose fuze of the mortar shell appropriately with a fire command during a loading process of the mortar shell performed by the loading device.

7. The weapon system as claimed in claim 5, wherein the loading device comprises an operating part that comprises a shroud, wherein the shroud is disposed to push the mortar shell axially into the weapon barrel and the operating part programs a nose fuze of the mortar shell during a loading process of the mortar shell performed by the loading device.

8. The weapon system as claimed in claim 1, wherein the mortar shell further comprises a programmable nose fuze, and in order to fire the mortar shell provided with the programmable nose fuze, the loading device of the weapon system comprises a fuze programming device that programs the nose fuze of the mortar shell appropriately with a fire command during a loading process of the mortar shell performed by the loading device.

9. The weapon system as claimed in claim 8, wherein the loading device comprises an operating part that comprises a shroud, wherein the shroud is disposed to push the mortar shell axially into the weapon barrel and the operating part programs the nose fuze during a loading process of the mortar shell performed by the loading device.

10. The weapon system as claimed in claim 1, wherein the loading device comprises an operating part that comprises a shroud, wherein the shroud is disposed to push the mortar shell axially into the weapon barrel and the operating part programs a nose fuze of the mortar shell during a loading process of the mortar shell performed by the loading device.

11. The weapon system as claimed in claim 10, wherein the loading device and the stripping device are arranged in the weapon area, and wherein the loading device and the stripping device are controlled from a crew area.

12. The weapon system as claimed in claim 11, wherein the mortar is controlled by crew located in the crew area while there are no crew in the weapon area.

13. A weapon system as claimed in claim 1, wherein the carrier vehicle comprises a separating wall provided between a crew area and the weapon area.

14. The weapon system as claimed in claim 13, wherein the separating wall between the crew area and the weapon area is made of armored steel.

15. The weapon system as claimed in claim 13, wherein the loading device and the stripping device are arranged in the weapon area, and wherein the loading device and the stripping device are controlled from the crew area.

16. The weapon system as claimed in claim 13, wherein the mortar is controlled by crew located in the crew area while there are no crew in the weapon area.

17. The weapon system as claimed in claim 1, wherein the mortar is a vehicle-mounted mortar mounted to the carrier vehicle.

18. A weapon system mountable to a carrier vehicle, wherein the weapon system comprises a mortar, wherein the mortar is capable of loading with a mortar shell, wherein the mortar shell has a plurality of first propellant charge modules that are capable of stripping off at a side of a fin structure of the mortar shell, and the mortar is pivotable from an index position to a firing position that is appropriate for one or more predetermined target parameters, wherein the weapon system further comprises:

(a) a weapon area that includes a controllable automatic loading device arranged to take the mortar shell from a munition magazine in the weapon area; and (b) a controllable automatic stripping device arranged to automatically push one or more second propellant charge modules of the plurality of first propellant charge modules off the fin structure of the mortar shell before the mortar shell is pushed into a weapon barrel of the mortar by the loading device, wherein the one or more second propellant charge modules are excess propellant charge modules that are not required after definition of the predetermined target parameters.

19. The weapon system as claimed in claim 18, further comprising:

(c) a collecting container arranged underneath the stripping device in order to collect the one or more second propellant charge modules stripped from the mortar shell by the stripping device, and wherein the weapon system is detachable from the carrier vehicle so as to function independently from the carrier vehicle.

20. The weapon system as claimed in claim 18, further comprising:

(c) a collecting container arranged at a side of the weapon area in order to collect the excess propellant charge modules stripped from the mortar shell by the stripping device, and wherein the weapon system is detachable from the carrier vehicle so as to function independently from the carrier vehicle.

21. A weapon system comprising a carrier vehicle and a mortar mounted to the carrier vehicle, wherein the mortar is capable of loading with a mortar shell, wherein the mortar shell has a plurality of first propellant charge modules that are capable of stripping off at a side of a fin structure of the mortar shell, and the mortar is pivotable from an index position to a firing position that is appropriate for one or more predetermined target parameters, wherein the weapon system further comprises:

(a) a weapon area that includes a controllable automatic loading device arranged to take the mortar shell from a munition magazine in the weapon area;

(b) a controllable automatic stripping device arranged to automatically push one or more second propellant charge modules of the plurality of first propellant charge modules off the fin structure of the mortar shell before the mortar shell is pushed into a weapon barrel of the mortar by the loading device, wherein the one or more second propellant charge modules are excess propellant charge modules that are not required after definition of the predetermined target parameters, and wherein the controllable automatic stripping device comprises two stripper parts that are moveable to automatically push the one or more second propellant charge modules off the fin structure of the mortar shell; and (c) a collecting container arranged underneath the stripping device or at a side of the weapon area in order to collect the one or more second propellant charge modules stripped from the mortar shell by the stripping device, wherein the mortar shell further comprises a programmable nose fuze, and in order to fire the mortar shell provided with the programmable nose fuze, the loading device of the weapon system comprises a fuze programming device that programs the nose fuze of the mortar shell appropriately with a fire command during a loading process of the mortar shell performed by the loading device, and wherein the loading device comprises an operating part that comprises a shroud, wherein the shroud is disposed to push the mortar shell axially into the weapon barrel and the operating part programs the nose fuze of the mortar shell during the loading process of the mortar shell performed by the loading device.

* * * * *